US011821190B2

(12) United States Patent
Papai

(10) Patent No.: US 11,821,190 B2
(45) Date of Patent: Nov. 21, 2023

(54) TANK FOR TOILET FLUSHING SYSTEM AND MANUFACTURING METHOD

(71) Applicant: Sloan Valve Company, Franklin Park, IL (US)

(72) Inventor: Richard Papai, Franklin Park, IL (US)

(73) Assignee: Sloan Valve Company, Franklin Park, IL (US)

( * ) Notice: Subject to any disclaimer, the term of this patent is extended or adjusted under 35 U.S.C. 154(b) by 0 days.

(21) Appl. No.: 17/749,780

(22) Filed: May 20, 2022

(65) Prior Publication Data

US 2022/0372742 A1 Nov. 24, 2022

Related U.S. Application Data

(60) Provisional application No. 63/191,465, filed on May 21, 2021.

(51) Int. Cl.
*E03D 3/10* (2006.01)

(52) U.S. Cl.
CPC ..... *E03D 3/10* (2013.01)

(58) Field of Classification Search
CPC ..... E03D 3/10
USPC ..... 4/354, 362
See application file for complete search history.

(56) References Cited

U.S. PATENT DOCUMENTS

| | | | | |
|---|---|---|---|---|
| 5,857,224 | A * | 1/1999 | Oberg | E03D 3/10 4/354 |
| 7,694,355 | B2 * | 4/2010 | Lo | E03D 3/10 4/354 |
| 2004/0194200 | A1 * | 10/2004 | Li | E03D 3/10 4/354 |
| 2006/0107451 | A1 * | 5/2006 | Kuster | E03D 3/10 4/354 |

* cited by examiner

*Primary Examiner* — Tuan N Nguyen
(74) *Attorney, Agent, or Firm* — Banner & Witcoff, Ltd.

(57) ABSTRACT

A tank for a pressure-assist toilet flush system includes a base having an outlet for discharging water from the tank and a cover connected to the upper end of the base at a tongue-and-groove joint. The base has a pair of first sidewalls extending downward from the upper end of the base along a length of the base, a pair of second sidewalls extending between the first sidewalls and downward from the upper end of the base, and a bottom wall connected to the first sidewalls and the second sidewalls, with the outlet defined in the bottom wall. The base also includes first and second cross-ribs connected to the first sidewalls and each having a bridge portion extending between the first sidewalls on opposite sides of the outlet, the first and second cross-ribs each having an opening between a bottom edge of the bridge portion and the bottom wall.

20 Claims, 15 Drawing Sheets

TANK FOR TOILET FLUSHING SYSTEM AND MANUFACTURING METHOD

CROSS-REFERENCE TO RELATED APPLICATION

This application is a nonprovisional of, and claims priority to, co-pending U.S. Provisional Application No. 63/191,465, filed May 21, 2021, which prior application is incorporated by reference herein in its entirety.

FIELD OF THE INVENTION

This disclosure relates to tank for a pressure assist toilet flush system, and more specifically to a two-piece tank with internal reinforcing structure and a method of manufacturing such a tank.

BACKGROUND

Plastic tanks or pressure vessels have been used extensively within the plumbing environment, such as for pressurized toilet flushing systems including pressure assist toilet flush systems. Tanks for pressure assist toilet flush systems undergo many thousands of periodic flushing cycles in their lifetimes, including relieving tank pressure momentarily, then re-pressurizing the tank, with each cycle exerting significant pressure on the tank. Such tanks are typically made from two pieces that are welded together to define a hollow cavity, and the joint between the two pieces is a common location of failures. An example of such a tank is described in U.S. Pat. No. 5,857,224, which is incorporated by reference herein. Expansion and contraction of the tank during flush cycles can place a great deal of stress on this joint, which contributes to such failures.

The present disclosure is provided to address this need and other needs in existing tanks for pressure assist toilet flush systems. A full discussion of the features and advantages of the present invention is deferred to the following detailed description, which proceeds with reference to the accompanying drawings.

BRIEF SUMMARY

Aspects of the disclosure relate to a tank for a pressure-assist toilet flush system, including a base having an outlet configured for discharging water from the tank and a cover connected to the upper end of the base, such that the cover and the base define a cavity configured to hold water to be discharged through the outlet. The base has a pair of first sidewalls extending downward from an upper end of the base along a length of the base, a pair of second sidewalls extending between the first sidewalls and downward from the upper end of the base, the first sidewalls having greater lengths than the second sidewalls, and a bottom wall connected to the first sidewalls and the second sidewalls, with the outlet defined in the bottom wall. The base also includes first and second cross-ribs connected to the first sidewalls and each having a bridge portion extending between the first sidewalls on opposite sides of the outlet, the first and second cross-ribs each having an opening between a bottom edge of the bridge portion and the bottom wall.

According to one aspect, the cover and the base are connected by a tongue-and-groove joint that extends around the upper end of the base.

According to another aspect, a first distance is defined between a center of the outlet and one of the second sidewalls, and the first cross-rib is positioned within 25% of the first distance from the center of the outlet. Additionally, a second distance is defined between a center of the outlet and the other of the second sidewalls, and the second cross-rib is positioned within 25% of the second distance from the center of the outlet.

According to a further aspect, the first and second cross-ribs each include a pair of sidewall portions extending vertically along the first sidewalls below the bottom edge of each of the bridge portions and extending inwardly from the first sidewalls, with the bridge portion of each of the first and second cross-ribs extending between the sidewall portions. In one configuration, the sidewall portions of the first and second cross-ribs have a curved fillet configuration at the bottom wall.

According to yet another aspect, the entire bottom edge of each of the bridge portions of the first and second cross-ribs is spaced from the bottom wall of the base.

According to a still further aspect, the cover has a receiver in a top wall of the cover, configured to receive a flush actuator to control discharge of water through the outlet.

According to an additional aspect, the base further has a plurality of sidewall ribs extending vertically along the first sidewalls and arranged in pairs extending inwardly toward each other from the first sidewalls. In one configuration, the sidewall ribs and the first and second cross-ribs are substantially evenly spaced along the first sidewalls.

According to another aspect, the base is formed of a composite material including a polymer matrix with short fiber reinforcement material having a fiber length of 0.125 inch to 0.177 inch. The fibers may be randomly aligned in the matrix in one embodiment.

Additional aspects of the disclosure relate to a tank for a pressure-assist toilet flush system, including a base defining a base cavity having an outlet configured for discharging water from the tank, the base having a plurality of sidewalls extending downward from an upper end of the base to define the base cavity, and a cover defining a cover cavity and having a lower end connected to the upper end of the base, such that the cover cavity and the base cavity define a cavity configured to hold water to be discharged through the outlet. The base further includes a first cross-rib and a second cross-rib connected to two of the sidewalls and extending across the base cavity and between the two sidewalls on opposite sides of the outlet. The lower end of the cover and the upper end of the base are connected at a joint extending around a periphery of the tank. The joint is a tongue-and-groove joint including a tongue extending from one of the lower end of the cover and the upper end of the base and a groove receiving the tongue within the other of the lower end of the cover and the upper end of the base. A weld material is positioned within the tongue-and-groove joint to bond the tongue within the groove, the weld material forming a watertight connection at the joint.

According to one aspect, the tongue is a continuous tongue extending around the entire periphery of the tank, and the groove is a continuous groove extending around the entire periphery of the tank.

According to another aspect, the tongue is connected to the cover and extends downward from the lower end of the cover, and the groove is formed in the base and extends downward from the upper end of the base.

According to a further aspect, the first cross-rib and the second cross-rib each have a bridge portion extending across the base cavity and between the two sidewalls and an opening between a bottom edge of the bridge portion and a bottom wall of the base. In one configuration, the first and second cross-ribs each comprise a pair of sidewall portions extending vertically along the two sidewalls below the bottom edge of each of the bridge portions and extending inwardly from the two sidewalls, with the bridge portion of each of the first and second cross-ribs extending between the sidewall portions.

According to yet another aspect, the base further includes a plurality of sidewall ribs extending vertically along the two sidewalls and arranged in pairs extending inwardly toward each other from the two sidewalls.

According to a still further aspect, the base is formed of a composite material comprising a polymer matrix with short fiber reinforcement material having a fiber length of 0.125 inch to 0.177 inch. In one configuration, the polymer matrix is formed of a crystalline polymer material.

Further aspects of the disclosure relate to a base for a tank for a pressure-assist toilet flush system, including a pair of first sidewalls extending downward from an upper end of the base along a length of the base, a pair of second sidewalls extending between the first sidewalls and downward from the upper end of the base, the first sidewalls having greater lengths than the second sidewalls, and a bottom wall connected to the first sidewalls and the second sidewalls, where an outlet is defined in the bottom wall and is configured for discharging water from the tank. The base also includes first and second cross-ribs connected to the first sidewalls on opposite sides of the outlet. Each of the first and second cross-ribs has a pair of sidewall portions extending vertically along the first sidewalls and extending inwardly from the first sidewalls, and a bridge portion extending between the sidewall portions. The first and second cross-ribs each have an opening between a bottom edge of the bridge portion and the bottom wall. The base further includes a plurality of sidewall ribs extending vertically along the first sidewalls and arranged in pairs extending inwardly toward each other from the first sidewalls.

According to one aspect, the sidewall portions of the first and second cross-ribs have a curved fillet configuration at the bottom wall, and at least some of the sidewall ribs have a curved fillet configuration at the bottom wall.

Other aspects of the disclosure relate to a method of manufacturing a base and/or a cover as described herein from a composite material including a polymer matrix and a short fiber reinforcement material. According to one aspect, the method uses at least two mold pieces, and at least one of the mold pieces is made from a beryllium-copper alloy or other material having a conductivity of at least 80 W/m-K. According to another aspect, the fibers have a fiber length of 0.125 inch to 0.177 inch. According to a further aspect, the polymer matrix is formed of a crystalline polymer material.

Other features and advantages of the disclosure will be apparent from the following description taken in conjunction with the attached drawings.

BRIEF DESCRIPTION OF THE DRAWINGS

To allow for a more full understanding of the present disclosure, it will now be described by way of example, with reference to the accompanying drawings in which.

DETAILED DESCRIPTION

Figure 1:
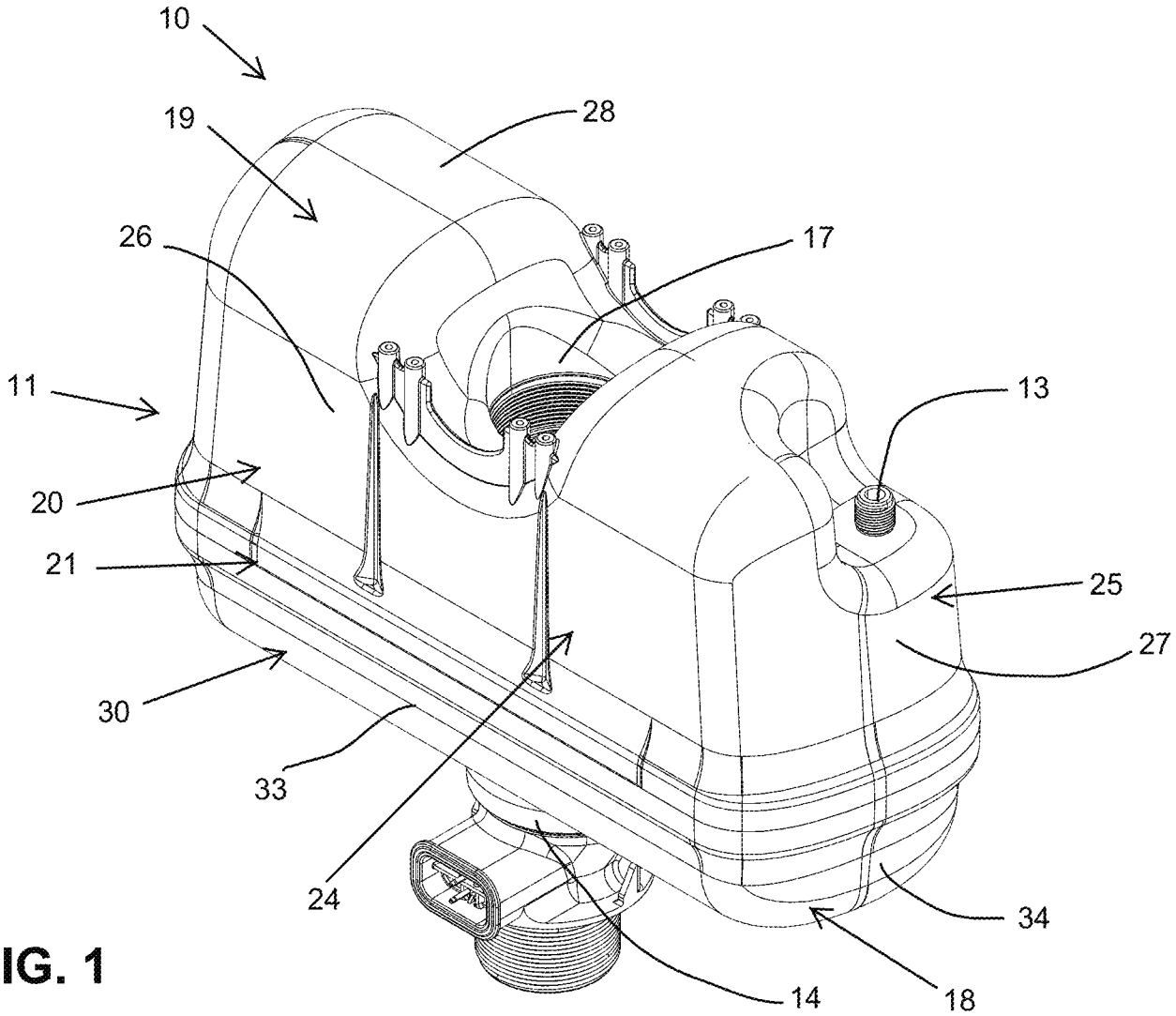
FIG. 1 is a perspective view of one embodiment of a tank of a pressure-assist toilet flush system according to aspects of the disclosure.
Figure 2:
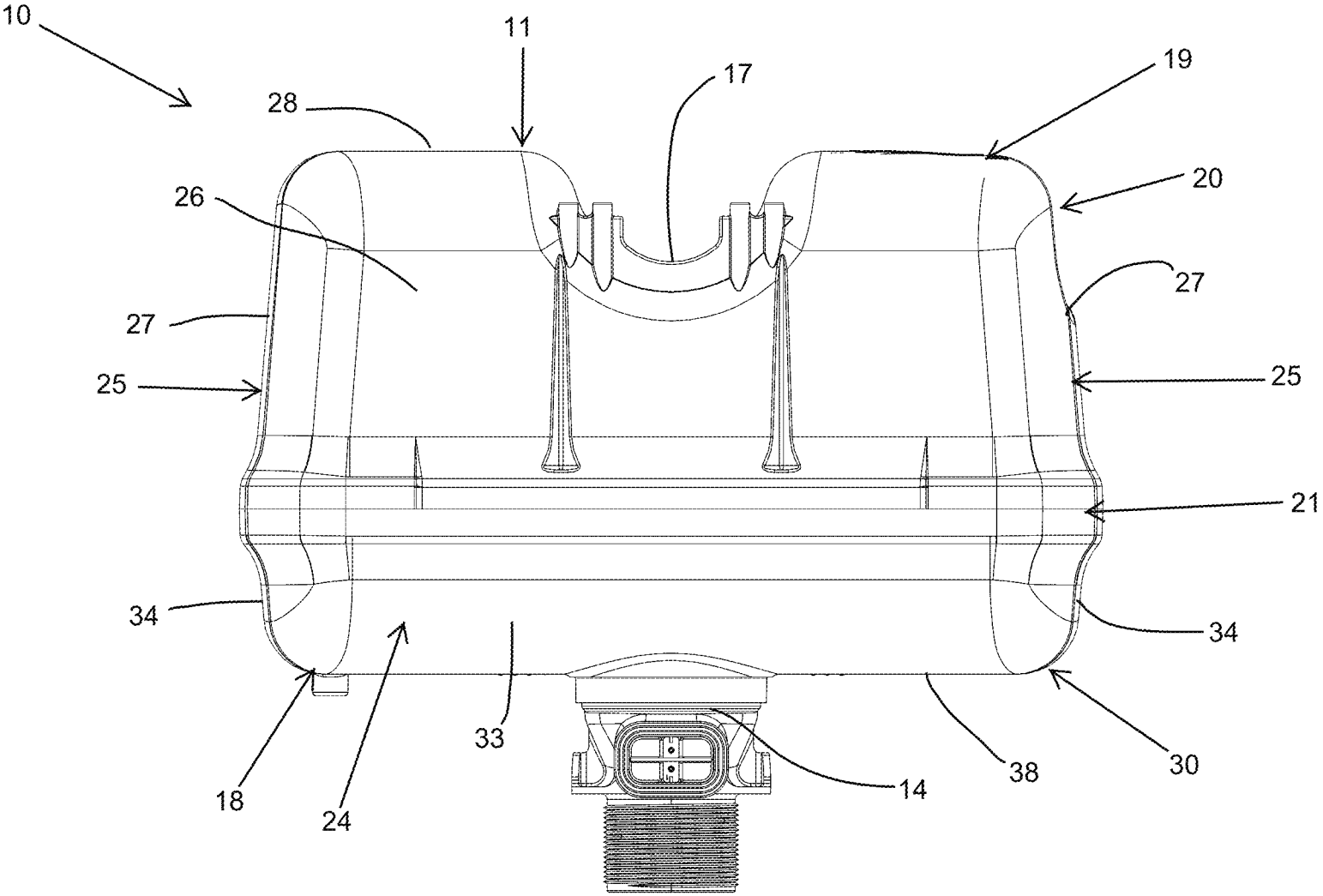
FIG. 2 is a front view of the tank of FIG. 1.
Figure 3:
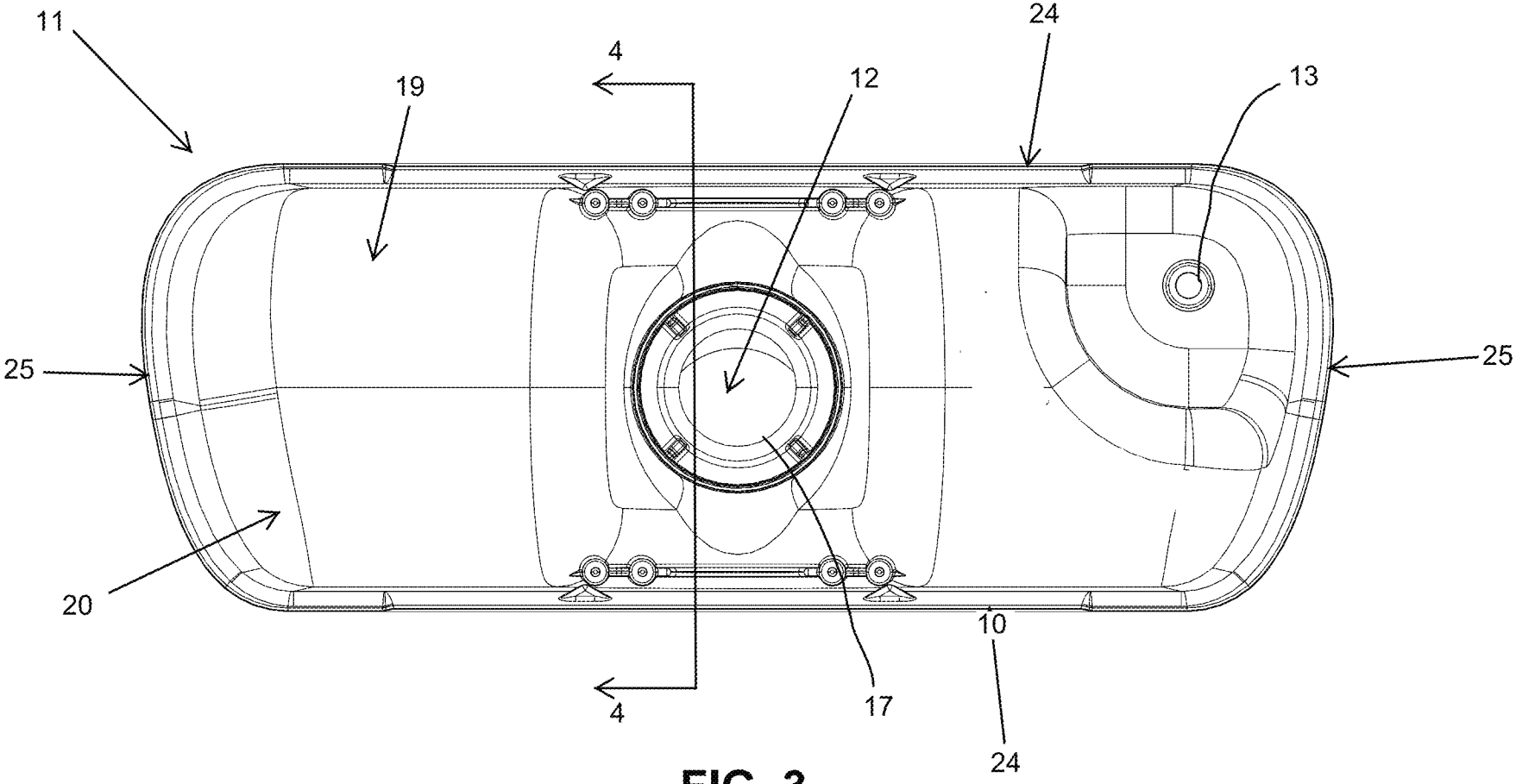
FIG. 3 is a top view of the tank of FIG. 1.

While this invention is susceptible of embodiments in many different forms, there are shown in the drawings and will herein be described in detail example embodiments of the invention with the understanding that the present disclosure is to be considered as an exemplification of the principles of the invention and is not intended to limit the broad aspect of the invention to the embodiments illustrated. In the following description of various example structures according to the invention, reference is made to the accompanying drawings, which form a part hereof, and in which are shown by way of illustration various example devices, systems, and environments in which aspects of the invention may be practiced. It is to be understood that other specific arrangements of parts, example devices, systems, and environments may be utilized and structural and functional modifications may be made without departing from the scope of the present invention.

Referring initially to FIGS. 1-4, there is shown an example embodiment of a pressure assist toilet flush system 10 that includes a tank 11 defining an internal cavity 12, with an inlet 13 and an outlet 14 for intake and discharge of water, and a flush actuator (not shown) configured for selectively opening and closing the outlet 14 to control discharge of water. The flush actuator 15 in this embodiment may be in the form of a replaceable flush cartridge mounted within a receiver 17 in the tank 11, such that a portion of the flush cartridge is accessible outside the tank 11 and the actuator 15 is positioned within the cavity 12 to interact with the outlet 14.

The tank 11 in the embodiment of FIGS. 1-4 includes a lower housing or base 30 forming a bottom portion 18 of the tank 11, and an upper housing or cover 20 forming a top portion 19 of the tank 11. The base 30 defines a base cavity 12A and the cover 20 defines a cover cavity 12B, such that the base cavity 12A and the cover cavity 12B combine to form the cavity 12. The cover 20 in this embodiment is shown in greater detail in FIGS. 5-8, and the base 30 is shown in greater detail in FIGS. 9-14. The base 30 of the tank 11 is connected to the cover 20 at a joint 21 that extends around the periphery of the tank 11. The outlet 14 for the tank 11 is located in the base 30, and the inlet 13 and the receiver 17 are located in the cover 20, in the embodiment of FIGS. 1-4. The base 30 also has supports 16 around the outlet 14 to form a rest for the flush actuator 15.

Figure 4:
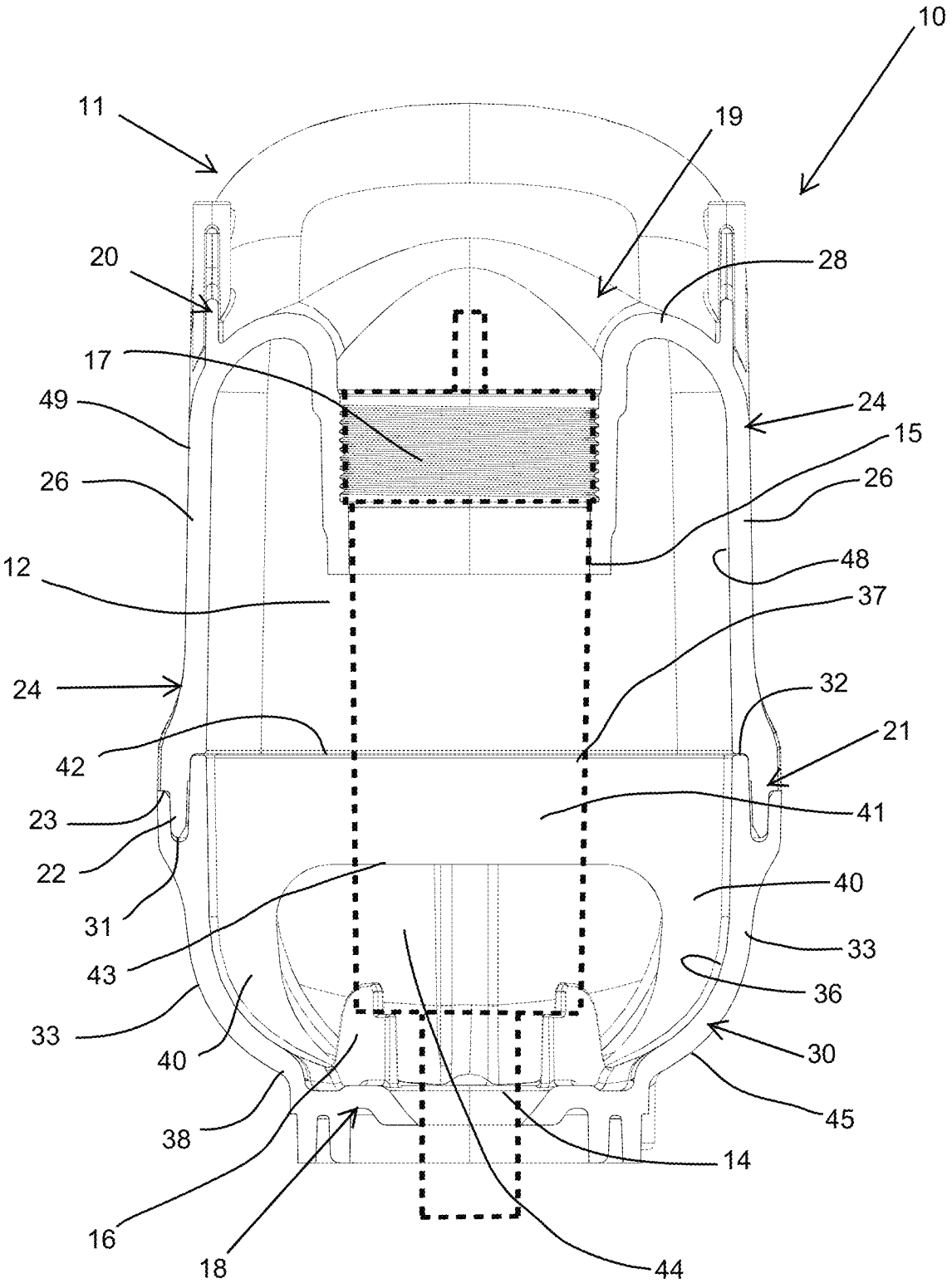
FIG. 4 is a cross-sectional view taken along lines 4-4 of FIG. 3.

The joint 21 in this embodiment is a tongue-and-groove joint that includes a groove 31 extending around the upper end 32 of the base 30 and a tongue 22 that extends downward from the cover 20 around the lower end 23 of the cover 20. The tongue 22 has a wall thickness that is smaller than the wall thickness of the lower end 23 of the cover 20. FIG. 4 illustrates the tongue 22 being received in the groove 31. In the embodiment of FIGS. 1-14, the tongue 22 and the groove 31 extend around the entire peripheries of the cover 20 and the base 30, respectively. In another embodiment, the tongue 22 and the groove 31 may be intermittent structures, such as a plurality of tongues 22 spaced around the lower end 23 of the cover 20 and either a single groove 31 or a plurality of grooves 31 spaced around the upper end 32 of the base 30. The joint 21 may further be strengthened and made watertight by the use of welding around the periphery of the tank 11, which may include the use of additional weld material to bond the connection. Radio Frequency (RF) welding is one technique that can be used to bond the base 30 to the cover 20 at the joint 21.

The tank 11 in FIGS. 1-4 is configured with a generally rectangular or trapezoidal peripheral shape, with two first or longer sides 24 that are generally parallel to each other and two second or shorter sides 25 extending between the first sides 24. The two second sides 25 are at oblique angles to each other in the embodiment of FIGS. 1-4 to create a generally trapezoidal shape, but may be generally parallel to each other in another embodiment to form a generally rectangular shape. The cover 20 and the base 30 may have the same peripheral shapes as the tank 11, as shown in FIGS. 5-14. The cover 20 has sidewalls defining a generally the same peripheral shape as the tank 11, including two first or longer sidewalls 26 and two second or shorter sidewalls 27 extending between the first sidewalls 26. The base 30 also has sidewalls defining a generally the same peripheral shape as the tank 11, including two first or longer sidewalls 33 and two second or shorter sidewalls 34 extending between the first sidewalls 33. Like the shape of the tank 11, the cover 20 and the base 30 may have a generally trapezoidal shape (with the second sidewalls 27, 34 being obliquely angled to each other) or a generally rectangular shape (with the second sidewalls 27, 34 being generally parallel to each other). It is understood that in a trapezoidal configuration, one of the first sides 24 and one of the first sidewalls 26, 33 will be longer than the other. The corners where the first and second sides 24 of the tank 11 meet are rounded, and the cover 20 and the base 30 have similar peripheral shapes. It is also understood that the tank 11, the cover 20, and the base 30 may have different peripheral shapes in other embodiments, such as an elliptical or obround shape or other shape.

Figure 5:
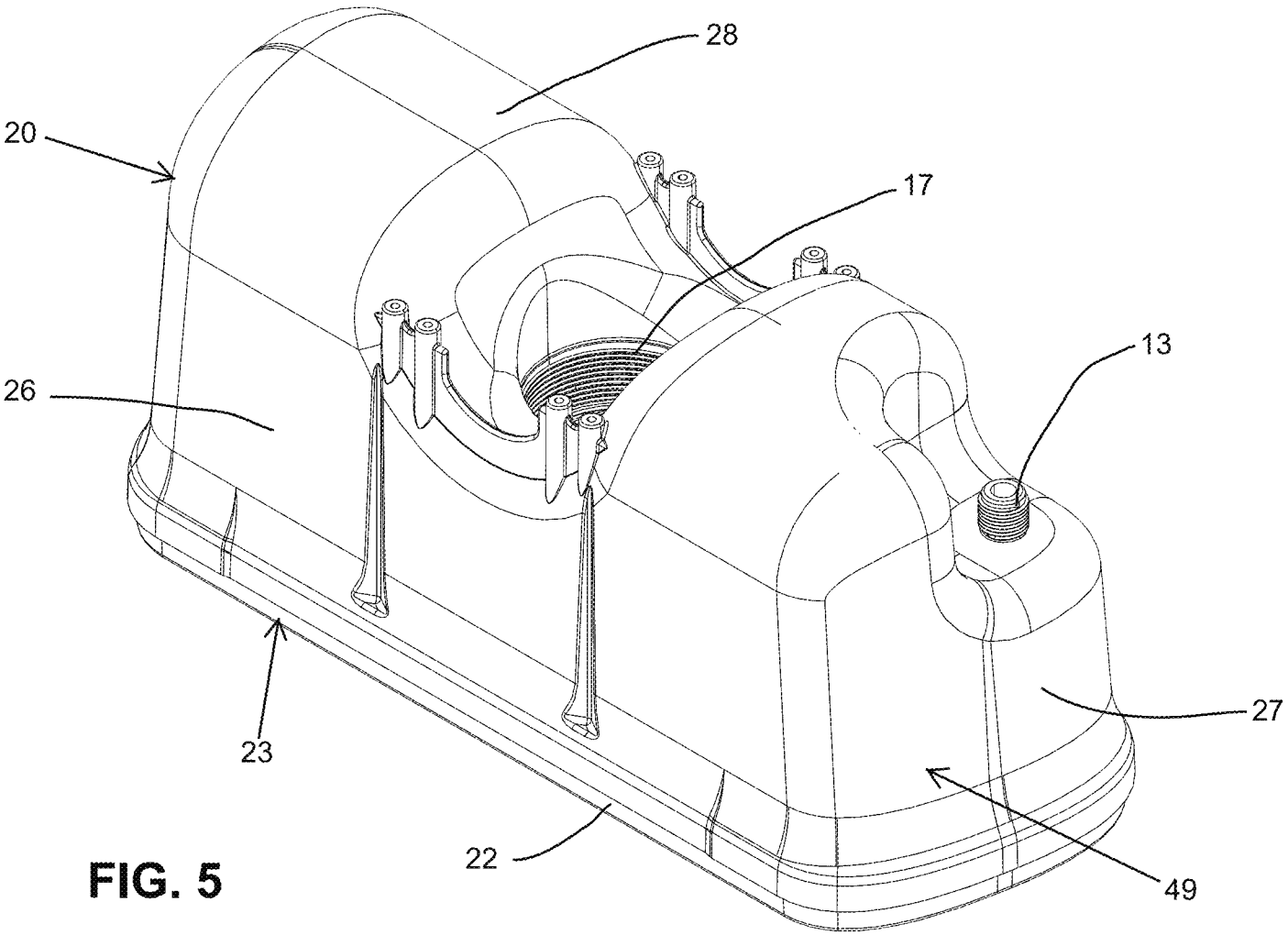
FIG. 5 is a perspective view of a cover of the tank of FIG. 1.
Figure 6:
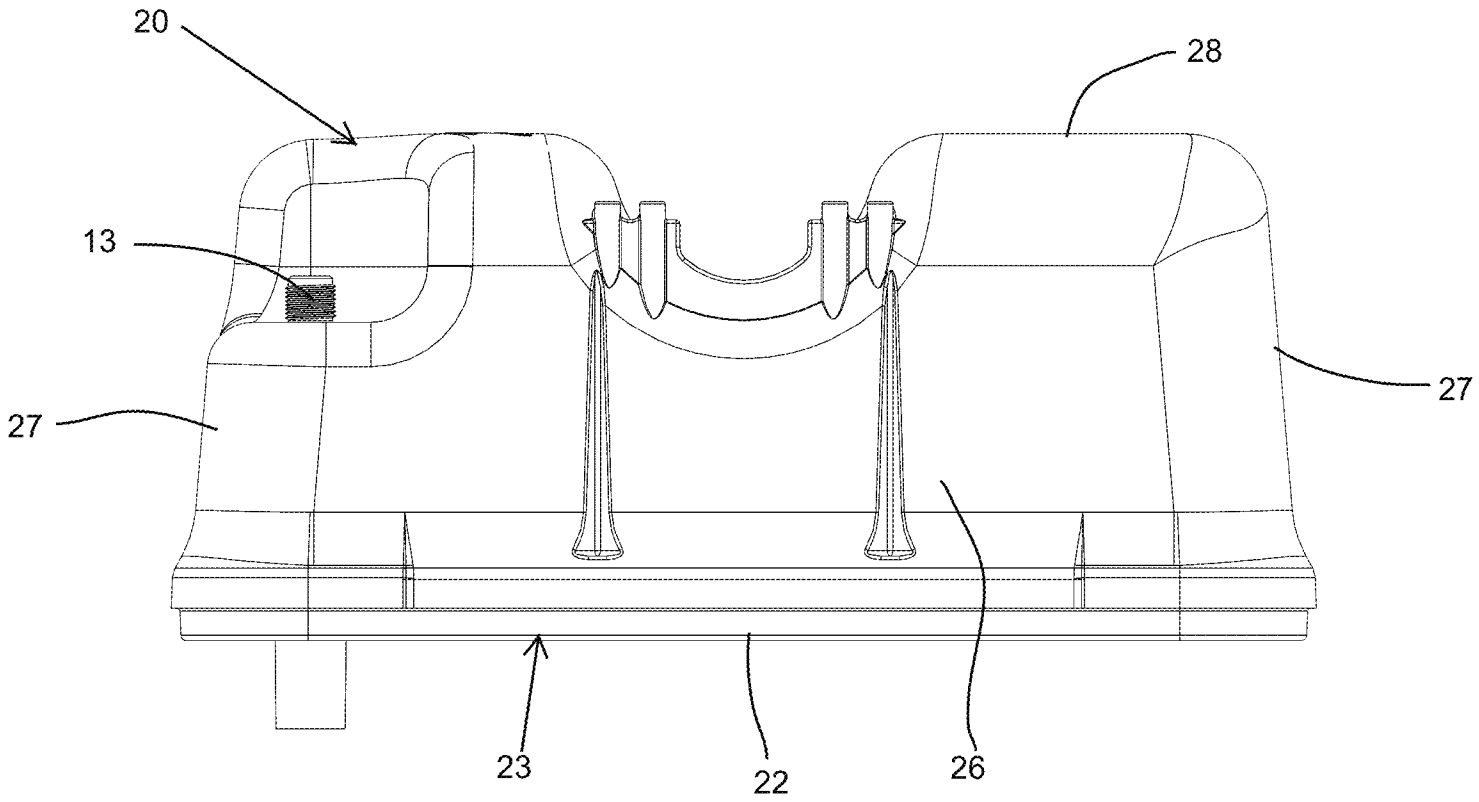
FIG. 6 is a rear view of the cover of FIG. 5.
Figure 7:
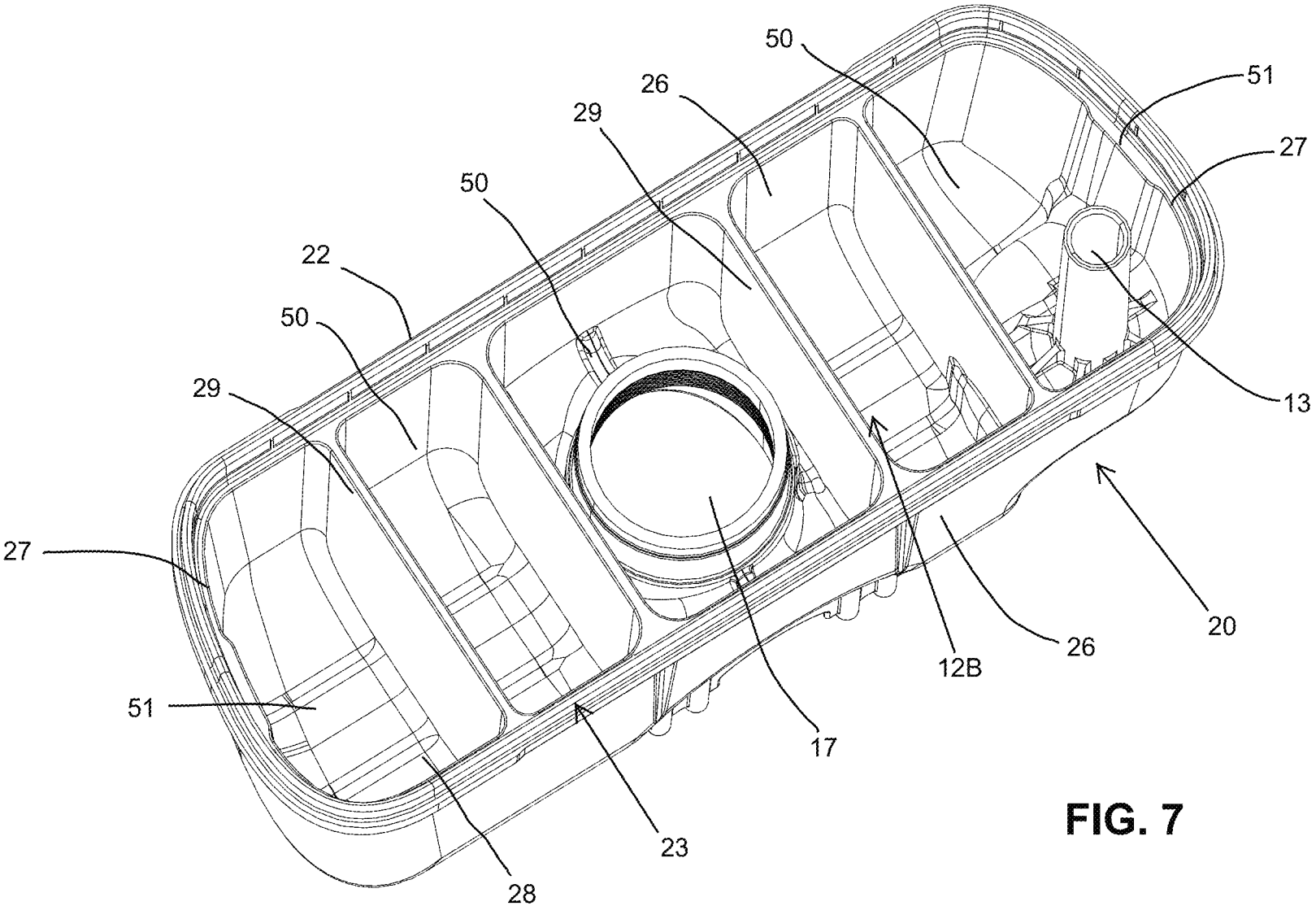
FIG. 7 is a bottom perspective view of the cover of FIG. 5.
Figure 8:
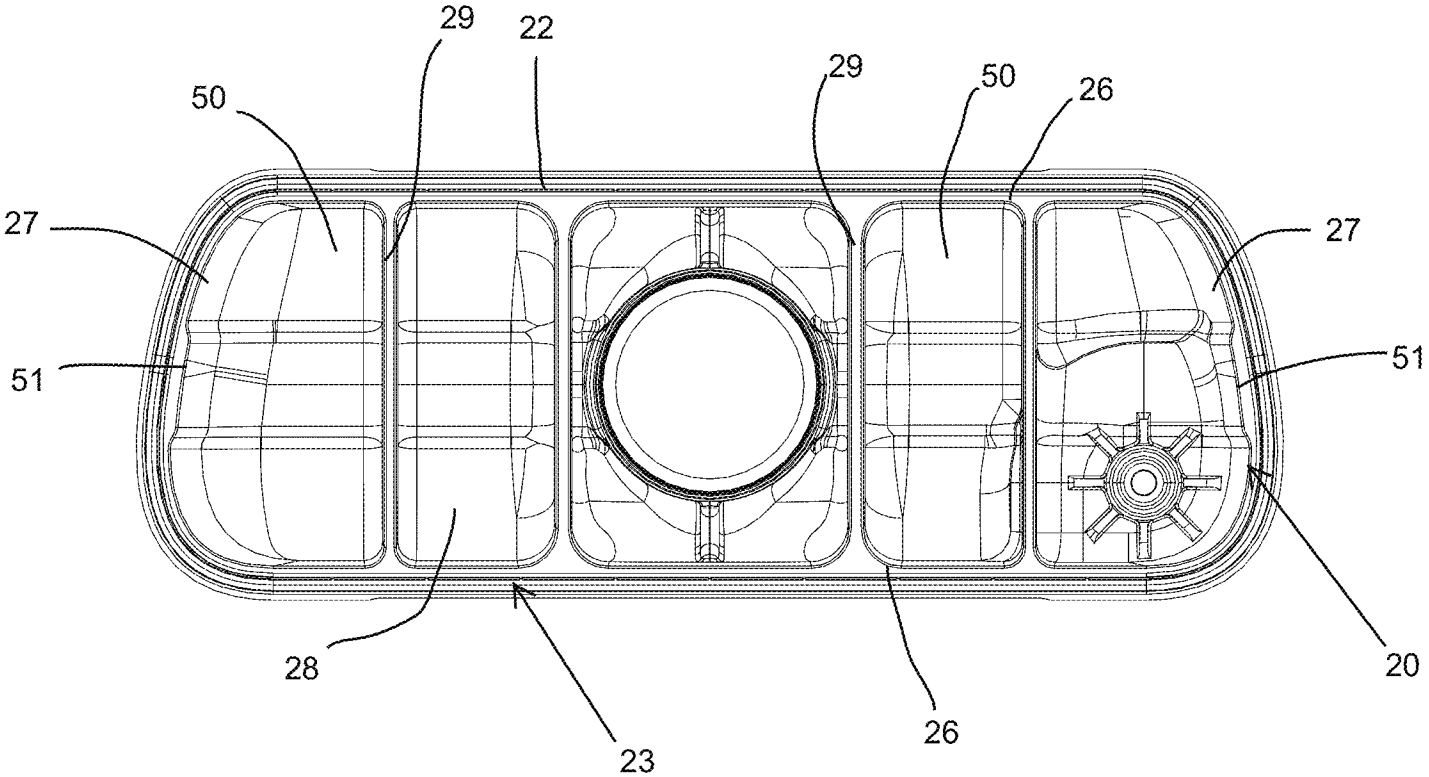
FIG. 8 is a bottom view of the cover of FIG. 5.
Figure 9:
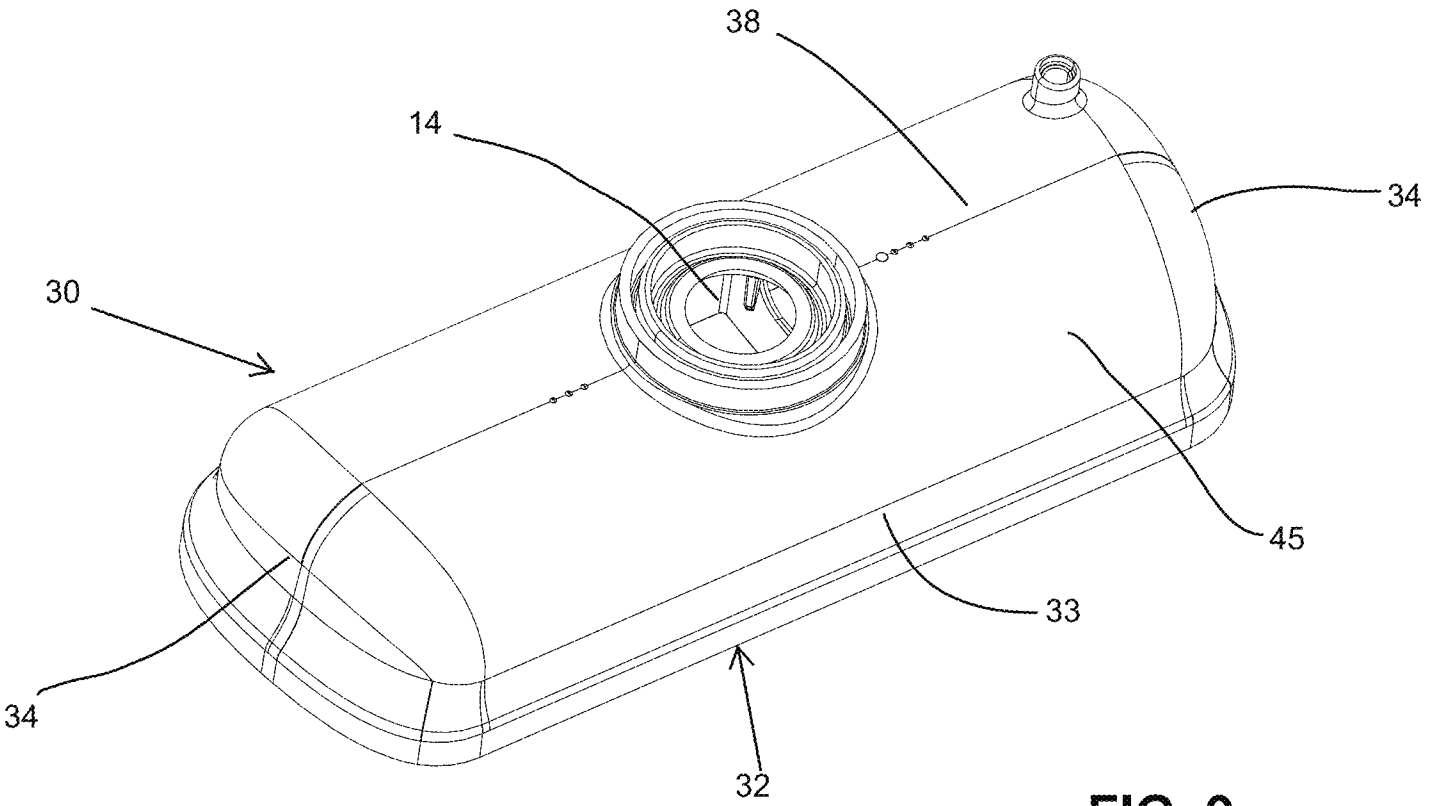
FIG. 9 is a bottom perspective view of a base of the tank of FIG. 1.
Figure 10:
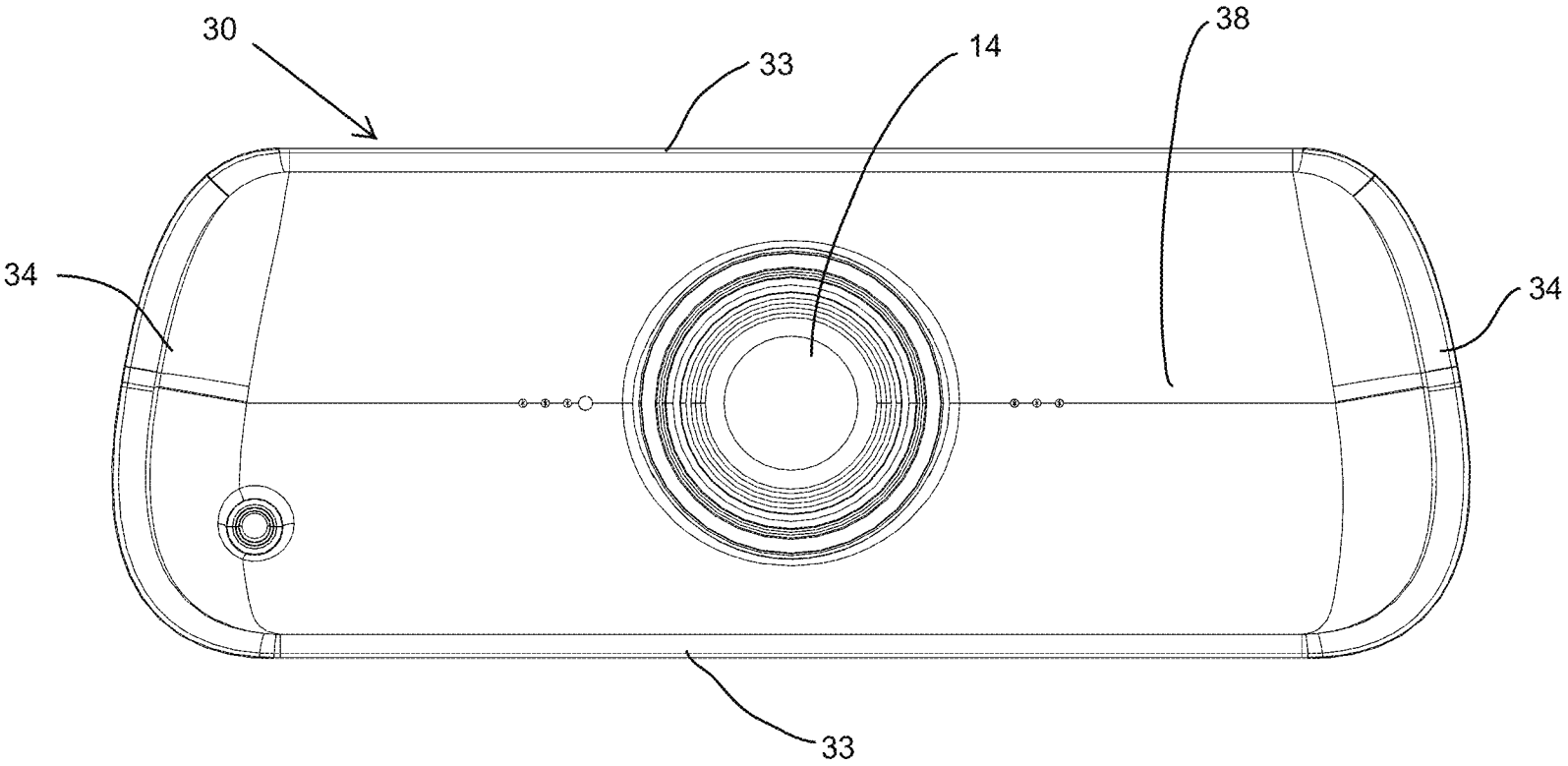
FIG. 10 is a bottom view of the base of FIG. 9.
Figure 11:
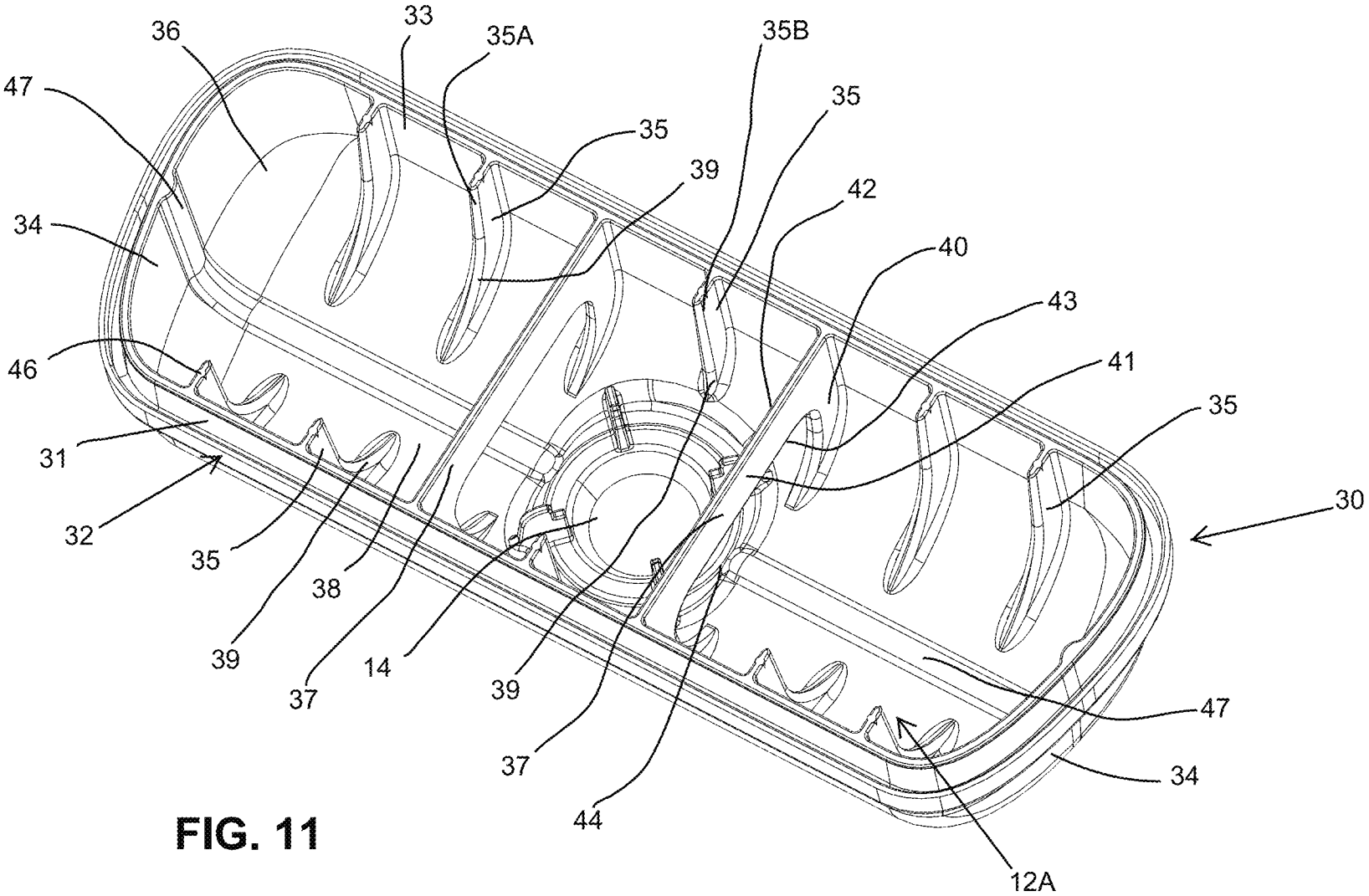
FIG. 11 is a top perspective view of the base of FIG. 9.
Figure 12:
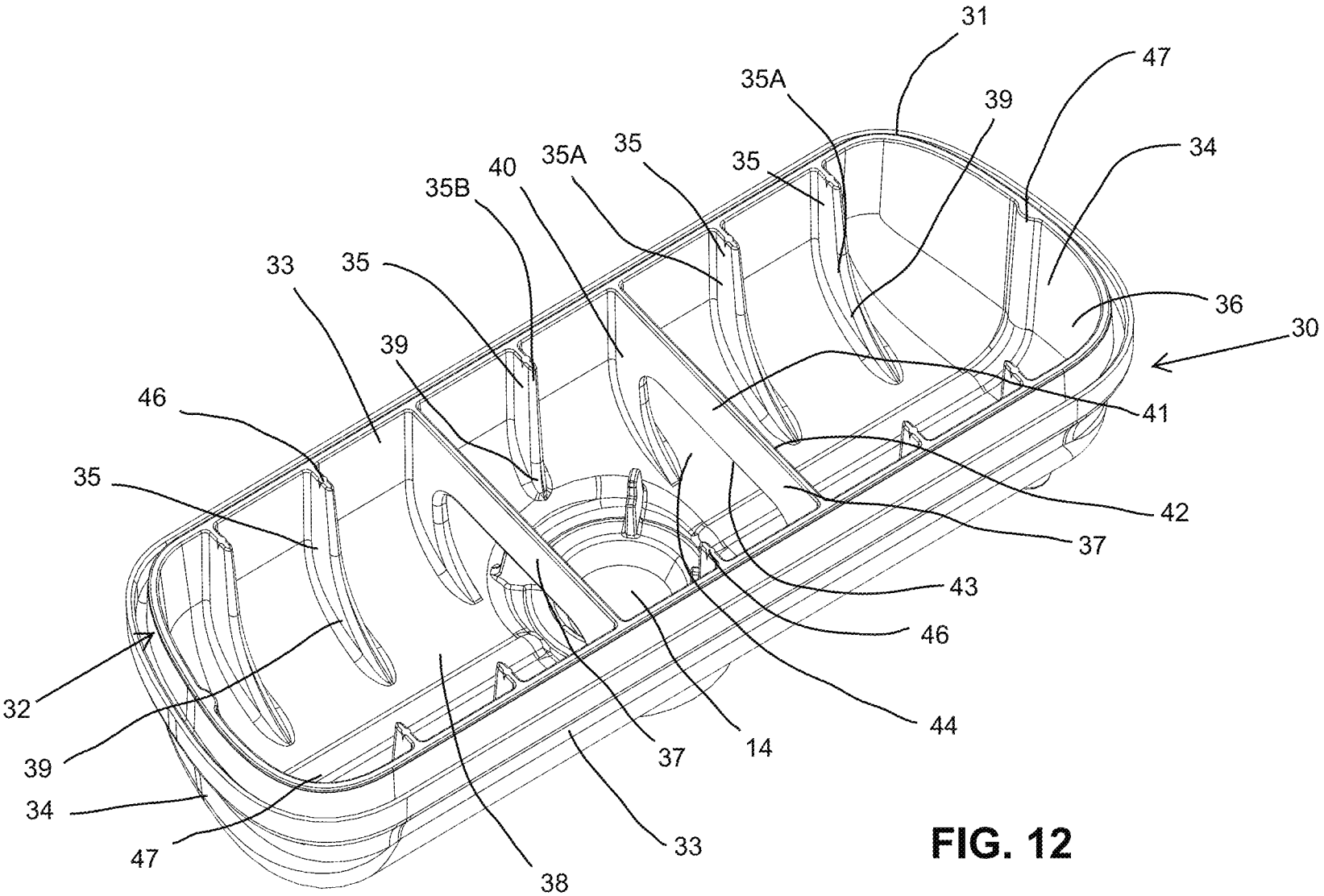
FIG. 12 is a top perspective view of the base of FIG. 9.
Figure 13:
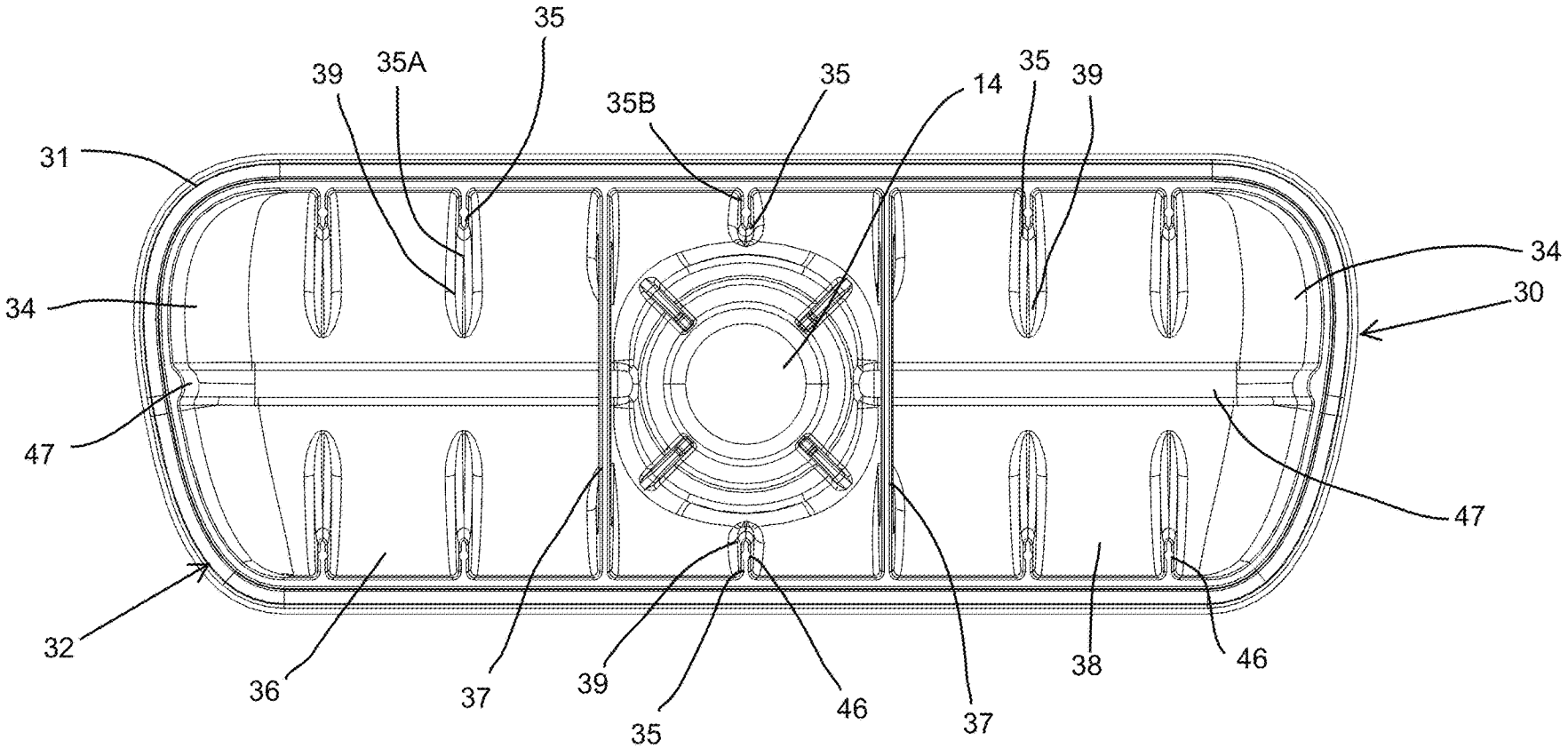
FIG. 13 is a top view of the base of FIG. 9.
Figure 14:
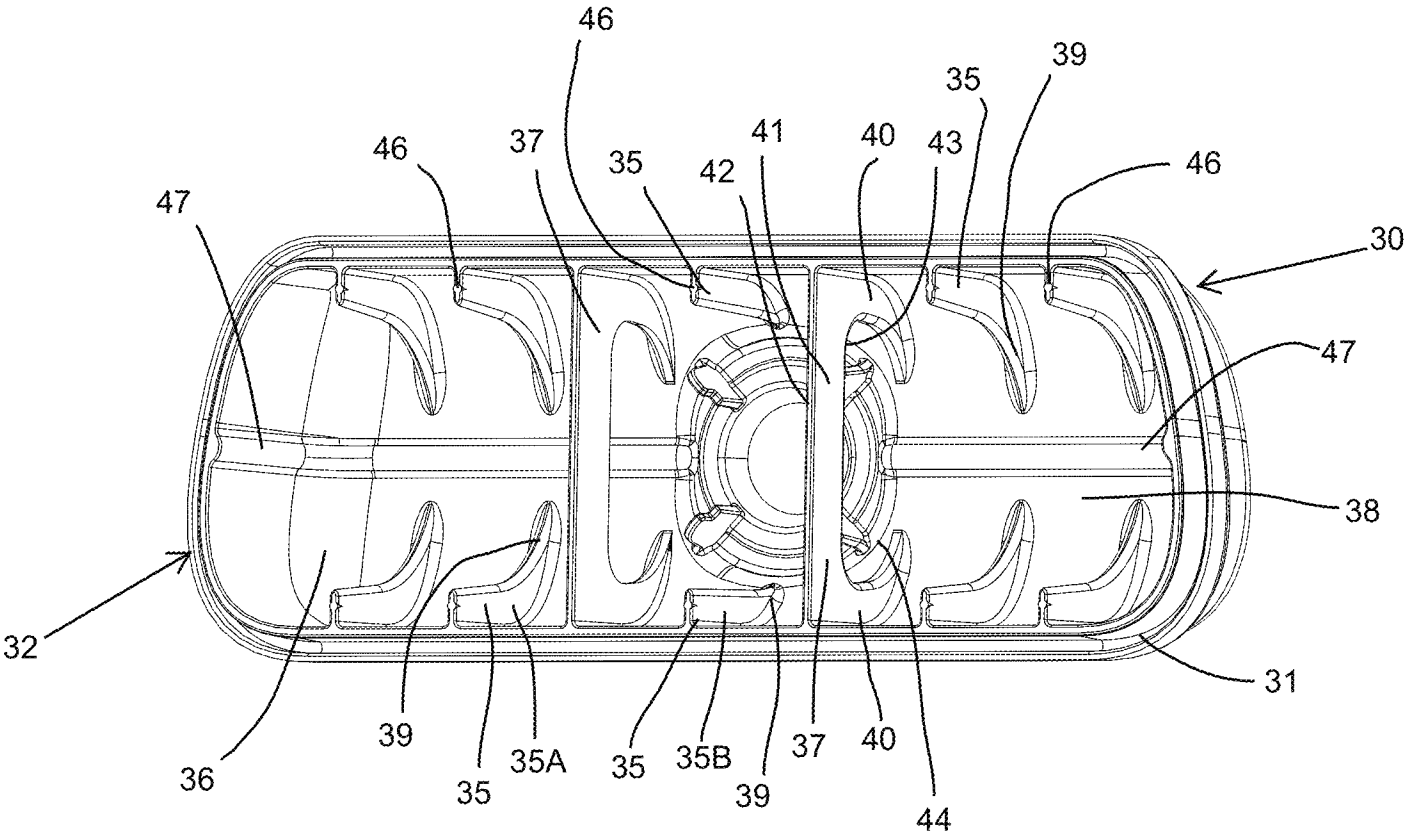
FIG. 14 is a top perspective view of the base of FIG. 9.

The cover 20 in FIGS. 5-8 includes a top wall 28 and the first and second sidewalls 26, 27 extending downward from the top wall 28 to the lower end 23, with the tongue 22 extending downward from the lower end 23 as described herein. The top wall 28 of the cover 20 is recessed around the receiver 17 and around the inlet 13, as seen in FIGS. 5-6. The cover 20 further has a plurality of internal walls 29 extending across the interior of the cover 20 between the first sidewalls 26 and from the top wall 28 to the lower end 23 or proximate to the lower end, providing the cover 20 with multiple separate chambers 50, as shown in FIGS. 7-8. The internal walls 29 may have different configurations in other embodiments, and may have openings and/or be configured as ribs such that the cover 20 does not have separate chambers.

The base 30 includes multiple reinforcing members to provide strength and rigidity to the base 30. Examples of such reinforcing members include a plurality of ribs, including sidewall ribs 35 extending along the inner surfaces 36 of the sidewalls and cross ribs 37 extending between the sidewalls. In the embodiment of FIGS. 9-14, the sidewall ribs 35 extend vertically along the inner surfaces 36 of the first sidewalls 33 and are spaced along the lengths of the first sidewalls 33. As seen in FIGS. 9-14, the sidewall ribs 35 in this embodiment are arranged as opposed pairs extending outward (or inward with respect to the base 30) toward each other from the opposed first sidewalls 33. Each of the opposed pairs of sidewall ribs 35 may be arranged to extend outward from the first sidewalls 33 in generally the same plane transverse to the first sidewalls 33. The sidewall ribs 35 in FIGS. 11-14 extend to the top ends of the first sidewalls 33, and each sidewall rib 35 further has a transverse portion 39 that extends along the bottom wall 38 of the base 30. The base 30 in FIGS. 9-14 has two types of sidewall ribs 35, including a first configuration 35A and a second configuration 35B. The sidewall ribs 35 having the first configuration 35A have the transverse portion 39 extending upward from the inner surface 36 of the bottom wall 38 of the base 30, such that each sidewall rib 35 has a curved fillet configuration at the transverse portion 39. The sidewall ribs 35 having the second configuration 35B are aligned with the outlet 14, and the transverse portions 39 of these sidewall ribs 35 have the transverse portion 39 extending along only a short distance along the bottom wall 38. In the embodiment of FIGS. 9-14, the sidewall ribs 35 include eight ribs having the first configuration 35A, positioned between the cross ribs 37 and the second sidewalls 34, and arranged into two pairs of sidewall ribs 35 on each side. Additionally, in the embodiment of FIGS. 9-14, the sidewall ribs 35 include two ribs having the second configuration 35B, positioned between the cross ribs 37 and aligned with the center of the outlet 14. The sidewall ribs 35 provide additional rigidity to the first sidewalls 33, which undergo the greatest amount of localized stress and strain during pressurizing and depressurizing of the tank 11 due to their longer lengths. In other embodiments, the sidewall ribs 35 may be differently configured and/or distributed along the first sidewalls 33, and/or the second sidewalls 34 may additionally or alternately also have sidewall ribs 35.

The base 30 in one embodiment has a plurality of cross ribs 37 connected to the first sidewalls 33 and extending between the first sidewalls 33 in a direction transverse to the first sidewalls 33, as shown in FIGS. 11-14. The base 30 in the embodiment of FIGS. 9-14 has two cross ribs 37 located on opposite sides of the outlet 14 for the flush cartridge 15, and spaced equal distances on either side of the outlet 14. Each cross rib 37 in this embodiment has two sidewall portions 40 that each extends vertically along one of the first sidewalls 33 and extends inwardly from the respective sidewall 33, and a bridge portion 41 that extends transversely between the two sidewall portions 40. The sidewall portions 40 in FIGS. 11-14 each have a curved fillet configuration at the bottom wall 38, similar to the sidewall ribs 35. The bridge portion 41 of each cross rib 37 has a first or top edge 42 and a second or bottom edge 43 that extend between the first sidewalls 33. The top edge 42 is generally level with the upper end 32 of the base 30, and the bottom edge 43 is spaced from the bottom wall 38 of the base 30 to create an opening 44 between the bottom wall 38 and the bottom edge 43 of the bridge portion 41. These openings 44 improve fluid flow and do not obstruct fluid flow into the outlet 14. In the embodiment of FIGS. 9-14, the opening 44 is defined by the bottom edge 43 of the bridge portion 41 and the sidewall portions 40 of the cross rib 37, and by the inner surface 36 of the bottom wall 38 of the base 30. In other embodiments (not shown), the cross rib 37 may have multiple openings 44, such as by having multiple bridge portions 41 (including optionally a bridge portion 41 contiguous with the bottom wall 38) with one or more openings 44 defined between them, or the cross rib 37 may extend all the way to the bottom wall 38 of the base 30 such that no opening 44 is present, among other configurations.

In one embodiment, the plurality of ribs (e.g., sidewall ribs 35 and cross ribs 37) are substantially evenly spaced along the first sidewalls 33, i.e., the distances between adjacent ribs vary by no more than 10%. This substantially even spacing distributes stress evenly around the periphery of the base 30 and avoids areas of high stress concentration that may shorten fatigue life. As shown in FIGS. 11-14, the sidewall ribs 35 and the cross ribs 37 in this embodiment are substantially evenly spaced along the first sidewalls 33. In another embodiment, the sidewall ribs 35 and the cross ribs 37 may be differently configured and/or distributed, such as having a greater or smaller number of each of the ribs 35, 37. In any such embodiment, the ribs may be substantially evenly spaced or otherwise distributed. Further, each of the sidewall ribs 35 in this embodiment has a flow guide 46 in the form of a rounded, enlarged section extending vertically along the respective rib 35 to the upper end 32 of the base 30, which help guide the flow of water out of the tank 11.

The configuration of the ribs (including the sidewall ribs 35 and cross ribs 37) described herein improves the strength, durability, toughness, and usage lifetime of the base 30, and also assists in manufacturing and assembly. The cross ribs 37 extending between the first sidewalls 33 provides significantly improved resistance to outward bulging of the sidewalls 33, which can occur due to water pressure increases in the tank 11 prior to flushing. The bridge portions 41 being located proximate to the lateral midline of each first sidewall 33 and proximate to the upper end 32 of the base 30 provide resistance to bulging at the location most susceptible to bulging (i.e., around the lateral midline) and most susceptible to damage by bulging (i.e., at the joint 21). The presence of the cross ribs 37 also resists warpage of the base 30 during and after manufacturing, particularly along the lateral midline of the first sidewalls 33, thereby improving linearity of the first sidewalls 33.

Warpage of the material can cause difficulties in achieving mating of the tongue 22 and the groove 31 of the cover 20 and the base 30, respectively, such that the components may need to be bent and/or forced together. The resultant joint 21 may contain significant residual stresses and may have tight fitting areas where the weld material does not penetrate during assembly, all of which may cause localized weakness and eventual failure. In fact, such residual stresses may occupy up to 20% of the material strength, greatly weakening the structure. The improved dimensions and dimensional stability produced by the configuration and manufacturing described herein provides better and more consistent dimensions of the weld area, which reduces or eliminates tights spots where the weld material cannot penetrate. For example, the cover 20 and the base 30 described herein can be assembled with 95-98% filling of the weld joint, which avoids weak spots and improves product life. Assembly of the tank 11 is also facilitated by the improved dimensions and dimensional stability.

Warpage may also result in decreased water tightness and leakage at the joint 21. The configurations of the sidewall ribs 35, including the filleted configurations thereof, also improve the strength, stiffness, and durability of the first sidewalls 33 and resist warpage of the base 30, further improving assembly and performance. It is understood that residual stresses resulting from warpage of the base 30 can also cause weakness in the cover 20, because these stresses can occupy a fraction of the tensile strength, leaving less effective tensile strength available to withstand loads. Thus, the configuration of the base 30 may improve the strength and lifetime of the cover 20 as well.

The base 30 and the cover 20 may be manufactured by molding in one embodiment, and may utilize at least inner and outer mold pieces that are pressed against the opposed inner and outer surfaces 36, 45, respectively, of the base 30 or the inner and outer surfaces 48, 49 of the cover 20, respectively, during molding. In the embodiment of FIGS. 1-14, the inner mold pieces or mold cores for forming the base 30 and the cover 20 each have a plurality of runners to assist in the flow of liquid material throughout the mold. The configuration of the mold core for the base 30 produces runners 47 on the inner surface 36 of the base 30 after manufacturing, and the runners 47 extend to the upper end 32 of the base 30. The runners 47 in this embodiment extend from the upper end 32 of the base 30 down the second sidewalls 34 and laterally across the bottom wall 38 to the outlet 14. The configuration of the mold core for the cover 20 produces runners 51 on the inner surface 48 of the cover 20 after manufacturing, and the runners 51 extend from the lower end 23 of the cover 20 down the second sidewalls 27 and laterally across the top wall 28 to the receiver 17. Additional or alternate runner configurations may be provided in other embodiments.

The runners 47, 51 in the embodiments of the base 30 and the cover 20 of FIGS. 1-14 are configured to increase the flow of liquid material into the mold. The mold for the base 30 is filled at or around the location of the inlet 14, and the mold for the cover 20 is filled at or around the location of the receiver 17. In this configuration, the last portions of the mold to fill are the portions farthest from the fill point, i.e., the second sidewall 27 and the lower end 23 of the cover 20 and the second sidewalls 34 and the upper end 32 of the base 30. These points are therefore most susceptible to warpage, and the quicker filling provided by the runners 47, 51 reduces potential warpage. For a crystalline polymer material such as polypropylene, this quicker filling also increases the crystallinity of the solidified material. This increased crystallinity, in turn, results in increased strength, toughness, and durability of the material forming the base 30 and the cover 20. The increased flow of material into the mold also reduces warpage of the material during and after solidification, the benefits of which are described elsewhere herein. It is understood that different structural configurations of the base 30 and the cover 20 may benefit more from different configurations of runners 47, 51, and that other components of the tank 11 manufactured by molding may also benefit from strategically designed runners and the resultant improved crystallinity of the material.

The manufacturing process and the properties of the base 30 can also be improved by the use of mold pieces made from materials having greater conductivity, particularly the mold core. For example, the material may have a conductivity of at least about 80 W/m-K or 80-200 W/m-K in one embodiment, or at least about 100 W/m-K or 100-200 W/m-K in another embodiment. The material of the mold pieces may also be selected based on durability, which can be an issue when casting fiber reinforced polymers such as glass-filled polypropylene or other plastics. Beryllium-copper alloys are one material that provides high thermal conductivity and good durability for this use. In one embodiment, at least one of the mold pieces, e.g., at least the mold core, is made from a beryllium-copper alloy. It is understood that the mold core may include moveable slider pieces to form the openings 44 beneath the bridge portions 41.

Figure 15:
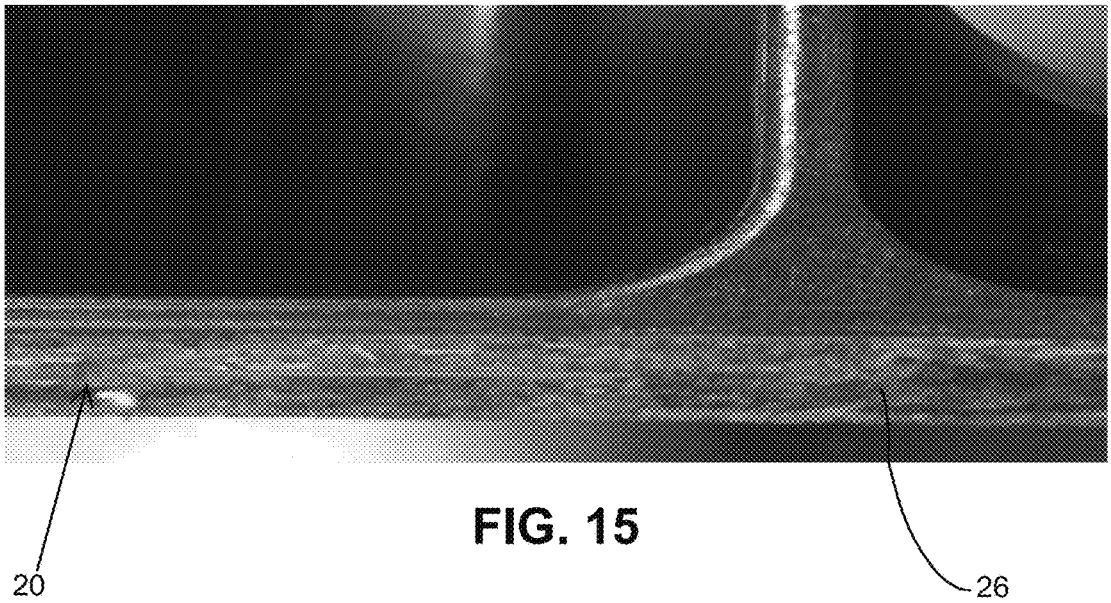
FIG. 15 is a photograph of a portion of a cover for a prior art tank of a pressure-assist toilet flush system, having long glass fiber reinforcement material, shown after rupture, with an arrow indicating the direction of alignment of the glass fibers.
Figure 16:
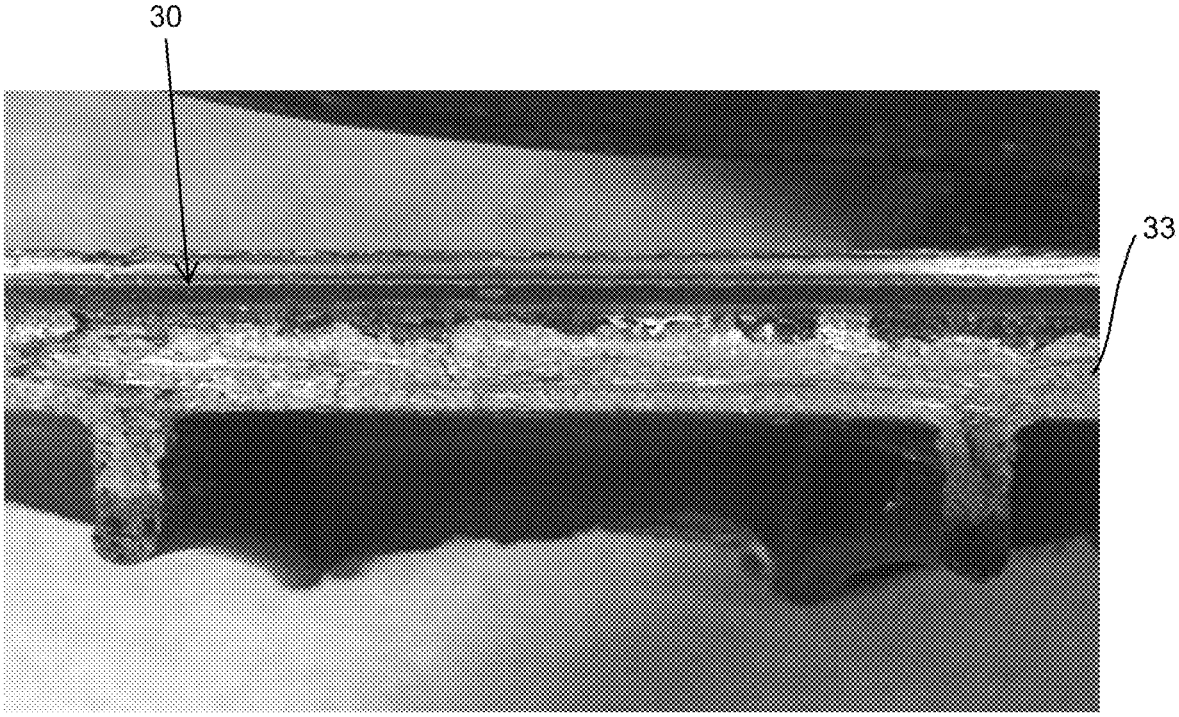
FIG. 16 is a photograph of a portion of a base for a prior art tank of a pressure-assist toilet flush system, with long glass fiber reinforcement material, shown after rupture, with an arrow indicating the direction of alignment of the glass fibers.

Some or all components of the tank 11 may be formed of a polymer composite material that includes a polymer matrix with a fiber reinforcement material. In one embodiment, the composite material uses a short-fiber reinforcement material. Surprisingly, and contrary to conventional wisdom, the use of short-fiber reinforcement material produces improved strength and durability in the components of the tank 11 compared to the use of long-fiber reinforcement material. The inventors have found that while long-fiber reinforcement is typically expected to produce higher strength, the fibers tends to align with each other during the molding process, creating highly directional strength properties. The resultant material possesses high strength with respect to bending forces exerted perpendicular to the direction of fiber alignment, but low strength with respect to bending forces exerted parallel to the direction of fiber alignment. Due to the structure and molding configuration of the cover 20 and the base 30, the fibers in the first sidewalls 26, 33 tend to align parallel to the direction of elongation of each sidewall 26, 33, as seen in FIGS. 15-16. Due to this alignment, bending stresses around the joint 21 resulting from bulging and cyclic flexing due to pressurization and depressurization create frequent failures around the joint 21. This is particularly true with respect to rotational stresses exerted at and around the joint 21, which are exerted along a line that is substantially parallel to the joint 21. Short fibers, when used as a reinforcement material, tend to be randomly aligned, and the material properties are not as dependent on fiber alignment. Thus, composite materials with short-fiber reinforcement material produce significantly greater strength, toughness, and durability in a tank 11, a cover 20, and/or a base 30 configured as described herein.

In one embodiment, the material of the cover 20 and/or the base 30 is a composite material with a polypropylene matrix and glass fibers as the reinforcement material. The combination of polypropylene and glass fibers is suitable for molding and welding as described herein. Other polymer/plastic matrix materials and/or other reinforcement materials may be used in other embodiments. The fibers may have a fiber length of 0.125 inch to 0.177 inch and/or an average fiber length of 0.150 inch, in one embodiment. The diameters of the fibers may be about 0.0005 inch. The solidified material of the cover 20 and the base 30 may contain the fibers at about 30% by weight in one embodiment, or about 25-35% by weight in another embodiment. However, other fiber fill ratios may be used in other embodiments to achieve desired properties, and the manufacturing methods described herein will function effectively with composite materials having higher or lower fill ratios.

The combination of reduced residual stresses at the joint 21 due to decreased warpage of the components and improved weld fill and flow, as well as the improved material properties provided by the short-fiber composite materials and the improved mold filling and solidification, as described herein, also create advantages in failure mode. More specifically, the base 30 and the cover 20 manufactured and configured as described herein tends to produce gradual and localized failures that begin as leakage, rather than catastrophic (e.g., bursting) failure. Residual stresses in and around the joint 21 create localized work hardening of the material of the tank 11, which makes the material more brittle and prone to catastrophic failure. The improved properties of the short-fiber composite material and the increased material crystallinity also assist in avoiding catastrophic failure. Further, the lifetime consistency of the tank is improved, because variations in factors such as warpage, localized material weakness, localized stress concentrations, etc., are reduced, and the consistency of weld quality is improved. Average product lifetime may be improved up to several fold, for example up to 4× or more, or even up to 10-20×, by the combination of configurations and methods described herein.

It is understood that any components of the tank 11 may include portions made from other materials, such as metals, ceramics, or other polymers or composites. Such portions may be separately formed and subsequently connected to the component(s) of the tank 11, or may be formed with the component(s) of the tank 11, such as by use of a mold insert, a multiple shot or co-molding process, or other technique.

Various embodiments of tanks for use in a pressure assist toilet flush system and methods for manufacturing the same have been described herein, which include various components and features. In other embodiments, the tank or the method may be provided with any combination of such components and features. It is also understood that in other embodiments, the various devices, components, and features of the tanks and the components thereof described herein may be constructed with similar structural and functional elements having different configurations, including different ornamental appearances.

Several alternative embodiments and examples have been described and illustrated herein. A person of ordinary skill in the art would appreciate the features of the individual embodiments, and the possible combinations and variations of the components. A person of ordinary skill in the art would further appreciate that any of the embodiments could be provided in any combination with the other embodiments disclosed herein. It is understood that the invention may be embodied in other specific forms without departing from the spirit or central characteristics thereof. The present examples and embodiments, therefore, are to be considered in all respects as illustrative and not restrictive, and the invention is not to be limited to the details given herein. The terms "top," "bottom," "front," "back," "side," "rear," "proximal," "distal," and the like, as used herein, are intended for illustrative purposes only and do not limit the embodiments in any way. When used in description of a method or process, the term "providing" (or variations thereof) as used herein means generally making an article available for further actions, and does not imply that the entity "providing" the article manufactured, assembled, or otherwise produced the article. Nothing in this specification should be construed as requiring a specific three dimensional orientation of structures in order to fall within the scope of this invention, unless explicitly specified by the claims. "Integral joining technique," as used herein, means a technique for joining two pieces so that the two pieces effectively become a single, integral piece, including, but not limited to, irreversible joining techniques such as welding, brazing, soldering, or the like, where separation of the joined pieces cannot be accomplished without structural damage thereto. Additionally, the term "plurality," as used herein, indicates any number greater than one, either disjunctively or conjunctively, as necessary, up to an infinite number. Accordingly, while the specific embodiments have been illustrated and described, numerous modifications come to mind without significantly departing from the spirit of the invention and the scope of protection is only limited by the scope of the accompanying claims.

What is claimed is:

1. A tank for a pressure-assist toilet flush system, the tank comprising:

a base having an outlet configured for discharging water from the tank, the base comprising:

a pair of first sidewalls extending downward from an upper end of the base along a length of the base;

a pair of second sidewalls extending between the first sidewalls and downward from the upper end of the base, the first sidewalls having greater lengths than the second sidewalls;

a bottom wall connected to the first sidewalls and the second sidewalls, wherein the outlet is defined in the bottom wall; and first and second cross-ribs connected to the first sidewalls and each having a bridge portion extending between the first sidewalls on opposite sides of the outlet, the first and second cross-ribs each having an opening between a bottom edge of the bridge portion and the bottom wall; and a cover connected to the upper end of the base, such that the cover and the base define a cavity configured to hold water to be discharged through the outlet.

2. The tank of claim 1, wherein the cover and the base are connected by a tongue-and-groove joint that extends around the upper end of the base.

3. The tank of claim 1, wherein a first distance is defined between a center of the outlet and one of the second sidewalls, and the first cross-rib is positioned within 25% of the first distance from the center of the outlet, and wherein a second distance is defined between a center of the outlet and the other of the second sidewalls, and the second cross-rib is positioned within 25% of the second distance from the center of the outlet.

4. The tank of claim 1, wherein the first and second cross-ribs each comprise a pair of sidewall portions extending vertically along the first sidewalls below the bottom edge of each of the bridge portions and extending inwardly from the first sidewalls, with the bridge portion of each of the first and second cross-ribs extending between the sidewall portions.

5. The tank of claim 4, wherein the sidewall portions of the first and second cross-ribs have a curved fillet configuration at the bottom wall.

6. The tank of claim 1, wherein the entire bottom edge of each of the bridge portions of the first and second cross-ribs is spaced from the bottom wall of the base.

7. The tank of claim 1, wherein the cover has a receiver in a top wall of the cover, configured to receive a flush actuator to control discharge of water through the outlet.

8. The tank of claim 1, wherein the base further comprises a plurality of sidewall ribs extending vertically along the first sidewalls and arranged in pairs extending inwardly toward each other from the first sidewalls.

9. The tank of claim 8, wherein the sidewall ribs and the first and second cross-ribs are substantially evenly spaced along the first sidewalls.

10. The tank of claim 1, wherein the base is formed of a composite material comprising a polymer matrix with short fiber reinforcement material having a fiber length of 0.125 inch to 0.177 inch.

11. A tank for a pressure-assist toilet flush system, the tank comprising:

a base defining a base cavity having an outlet configured for discharging water from the tank, the base comprising a plurality of sidewalls extending downward from an upper end of the base to define the base cavity, the base further comprising a first cross-rib and a second cross-rib connected to two of the sidewalls and extending across the base cavity and between the two sidewalls on opposite sides of the outlet; and a cover defining a cover cavity and having a lower end connected to the upper end of the base, such that the cover cavity and the base cavity define a cavity configured to hold water to be discharged through the outlet, wherein the lower end of the cover and the upper end of the base are connected at a joint extending around a periphery of the tank, wherein the joint is a tongue-and-groove joint comprising a tongue extending from one of the lower end of the cover and the upper end of the base and a groove receiving the tongue within the other of the lower end of the cover and the upper end of the base, and wherein a weld material is positioned within the tongue-and-groove joint to bond the tongue within the groove, the weld material forming a watertight connection at the joint.

12. The tank of claim 11, wherein the tongue is a continuous tongue extending around the entire periphery of the tank, and the groove is a continuous groove extending around the entire periphery of the tank.

13. The tank of claim 11, wherein the tongue is connected to the cover and extends downward from the lower end of the cover, and the groove is formed in the base and extends downward from the upper end of the base.

14. The tank of claim 11, wherein the first cross-rib and the second cross-rib each have a bridge portion extending across the base cavity and between the two sidewalls and an opening between a bottom edge of the bridge portion and a bottom wall of the base.

15. The tank of claim 14, wherein the first and second cross-ribs each comprise a pair of sidewall portions extending vertically along the two sidewalls below the bottom edge of each of the bridge portions and extending inwardly from the two sidewalls, with the bridge portion of each of the first and second cross-ribs extending between the sidewall portions.

16. The tank of claim 11, wherein the base further comprises a plurality of sidewall ribs extending vertically along the two sidewalls and arranged in pairs extending inwardly toward each other from the two sidewalls.

17. The tank of claim 11, wherein the base is formed of a composite material comprising a polymer matrix with short fiber reinforcement material having a fiber length of 0.125 inch to 0.177 inch, wherein the short fiber reinforcement material has a random alignment within the polymer matrix.

18. The tank of claim 17, wherein the polymer matrix is formed of a crystalline polymer material.

19. A base for a tank for a pressure-assist toilet flush system, the base comprising:

a pair of first sidewalls extending downward from an upper end of the base along a length of the base;

a pair of second sidewalls extending between the first sidewalls and downward from the upper end of the base, the first sidewalls having greater lengths than the second sidewalls;

a bottom wall connected to the first sidewalls and the second sidewalls, wherein an outlet is defined in the bottom wall and is configured for discharging water from the tank;

first and second cross-ribs connected to the first sidewalls on opposite sides of the outlet, each of the first and second cross-ribs having a pair of sidewall portions extending vertically along the first sidewalls and extending inwardly from the first sidewalls, and a bridge portion extending between the sidewall portions, the first and second cross-ribs each having an opening between a bottom edge of the bridge portion and the bottom wall; and a plurality of sidewall ribs extending vertically along the first sidewalls and arranged in pairs extending inwardly toward each other from the first sidewalls.

20. The base of claim 19, wherein the sidewall portions of the first and second cross-ribs have a curved fillet configuration at the bottom wall, and at least some of the sidewall ribs have a curved fillet configuration at the bottom wall.

* * * * *